United States Patent [19]

Millard et al.

[11] Patent Number: 4,725,261

[45] Date of Patent: Feb. 16, 1988

[54] CUTTING CARTON BLANKS AND CUTTERS THEREFOR

[75] Inventors: Michael W. Millard, Baldwin; Henry L. Dunn, Jr., Parkton, both of Md.

[73] Assignee: The Ward Machinery Company, Cockeysville, Md.

[21] Appl. No.: 944,442

[22] Filed: Dec. 19, 1986

[51] Int. Cl.[4] ..... B31B 1/14

[52] U.S. Cl. ..... 493/82; 493/60; 493/64; 493/342; 493/370; 83/121; 83/145; 83/500

[58] Field of Search ..... 493/60, 65, 82, 83, 493/342, 362, 365, 370, 373, 64; 83/500, 678, 121, 122, 145

[56] References Cited

U.S. PATENT DOCUMENTS

| | | | |
|---|---|---|---|
| 3,033,064 | 5/1962 | Lee | 83/500 |
| 3,329,049 | 7/1967 | Hubbard | 83/678 |
| 3,353,460 | 11/1967 | Henc | 493/342 |
| 3,518,922 | 7/1970 | Kuehn . | |
| 3,540,357 | 11/1970 | Ward, Jr. . | |
| 4,295,842 | 10/1981 | Bell . | |
| 4,530,693 | 7/1985 | Isoua | 493/342 |

*Primary Examiner*—Frederick R. Schmidt

*Assistant Examiner*—Robert Showalter

*Attorney, Agent, or Firm*—Boyce C. Dent; Edward D. C. Bartlett

[57] ABSTRACT

Apparatus and method for cutting an end portion of a carton blank, e.g. to form a stitch flap, employs a rotatably driven male cutting head cooperating with a rotatably driven female cutting head. The female cutting head has a peripheral cutting groove therein and an anvil surface adjacent one side of the groove. The male cutting head has a two edged slot cutting blade of predetermined arcuate length which enters the groove each revolution, and a knife which extends transversely away from the blade and engages the anvil surface each revolution. The blade has a scallop-like cut-out in the side adjacent the anvil surface. The cut-out modifies the blade to a single edged cutting blade for a small part of its length. Scrap portions produced from the carton blank by a slotting cut of the blade and a transverse cut of the knife are integrally connected together by a bridging piece enabled by this cut-out. This integral piece of scrap is conveyed by the groove to a stripping blade and then drops onto a conveyor, so eliminating any uncontrolled portion of scrap. The groove can have radial side channels for more positively gripping strips of scrap engaged therein.

23 Claims, 14 Drawing Figures

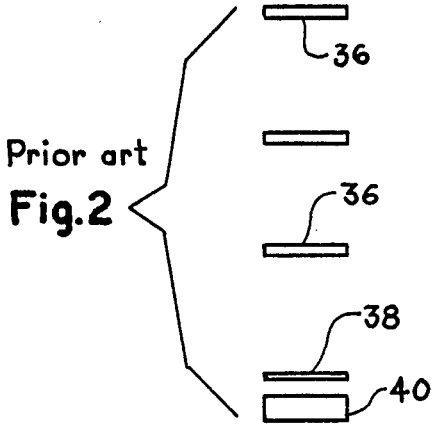
Prior art
Fig.2
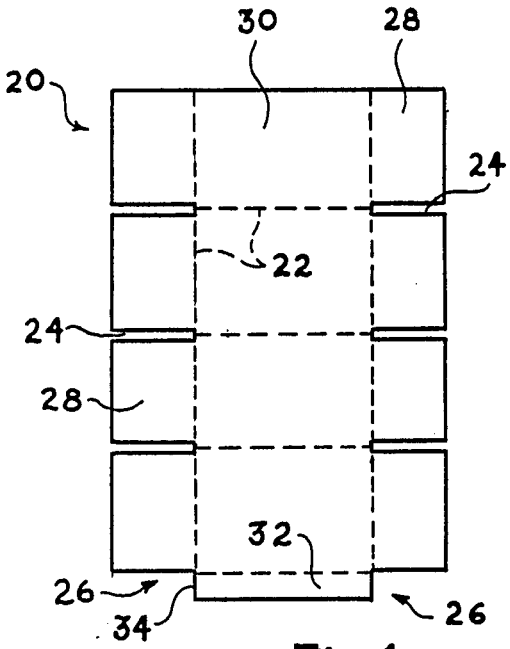
Prior art Fig. 1
Fig.3
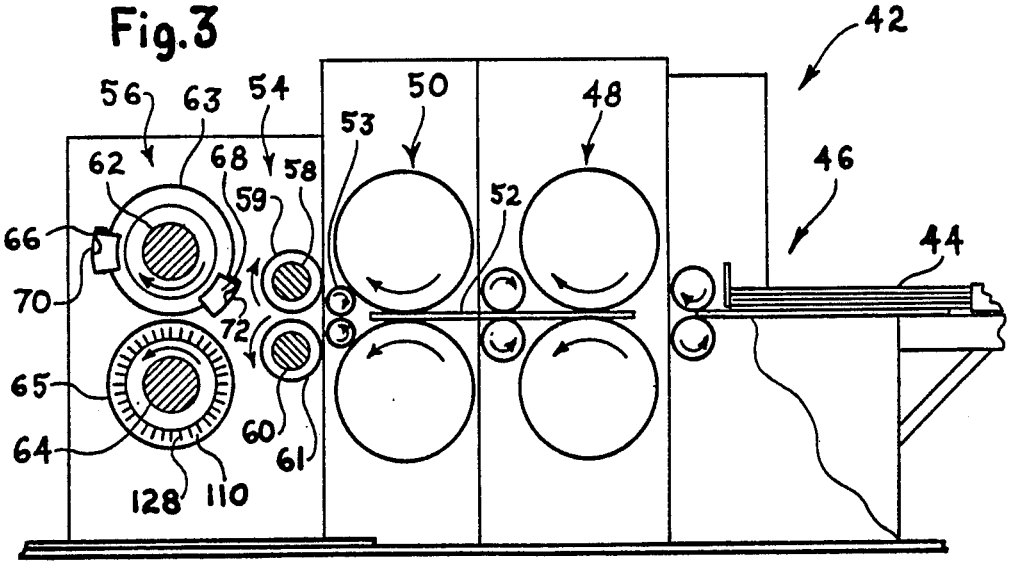

CUTTING CARTON BLANKS AND CUTTERS THEREFOR

FIELD OF THE INVENTION

This invention relates to cutting carton blanks, particularly to slot cutting, and cutter arrangements therefor.

BACKGROUND OF THE INVENTION

In the corrugated paperboard industry it is well known to perform slotting operations, for example in the production of carton blanks to define flaps thereof. For example, rotary slot cutting heads for performing such operations are disclosed in U.S. Pats. Nos. 3,518,922 and 3,540,357. It is also known to employ cross-cut knives to make transverse cuts adjacent slots to form a stitch flap at one end of carton blanks. An example of a cross-cut knife is disclosed in U.S. Pat. No. 4,295,842.

One of the problems associated with these slotting operations, particularly when associated with crosscutting to form a stitch flap, is control and removal of the scrap produced. U.S. Pat. No. 4,295,842 referred to above discloses an arrangement for removing paperboard scrap.

Apparatus for slotting and cutting carton blanks is frequently incorporated in flexographic printer slotter machines which produce finished printed carton blanks from sheets of corrugated paperboard.

SUMMARY OF THE INVENTION

The present invention is concerned generally with controlling the scrap produced when making slot cuts, particularly when making combined slot and cross cuts in a paperboard sheet or the like. The invention is particularly concerned with controlling scrap when forming a stitch flap in a carton blank.

It is an object of the present invention to produce integrally connected portions of scrap when cutting and/or shaping an end of a carton blank, such as when forming one end of a stitch flap, using combined slot and cross cuts.

A feature by which this is achieved is the provision of a cut-out in a side of a slot cutting blade to enable a bridging piece to be left between the strip-like portion of scrap from the slot cut and another portion of scrap formed between the slot cut and a cross cut.

This has the advantage that by controlling the strip-like portion of scrap, the other portion of scrap is automatically controlled as it is integrally attached to the striplike portion by the bridging piece. The strip-like scrap portion can be controlled by causing it to wedge in the groove of a female slot cutting head, and then positively removing it from this groove, for example by a cam-like blade engaged in the groove with a conveyor therebelow.

It is another object of the present invention to provide for more positive control of strip-like scrap in the groove of a female slot cutting head. This is achieved by forming outwardly extending, preferably radial, channels in the side walls of the groove. This has the advantage of allowing edges of the strip-like scrap to expand into these channels so keying the strip-like scrap in the groove until stripped therefrom.

Accordingly, therefore, there is provided by one aspect of the present invention an apparatus for forming a stitch flap in a carton blank, comprising a rotatably driven male cutting head cooperating with a rotatably driven female cutting head. The female cutting head has a peripheral cutting groove therein and an anvil surface adjacent one side of this groove. The male cutting head has a two edged slot cutting blade of predetermined arcuate length which enters the groove, and a knife which extends transversely away from the blade and engages the anvil surface. The blade has a cut-out in one side thereof adjacent said one side of the groove and extending along a portion of said arcuate length, this cut-out modifying the blade to a single edged cutting blade along said portion, whereby scrap portions produced from the carton blank by a slotting cut of the blade and a transverse cut of the knife are connected together by a bridging piece enabled by the cut-out.

Advantageously, said portion of said arcuate length is intermediate ends of the predetermined arcuate length of the blade. This portion is preferably spaced inwardly from both ends of the blade, and is preferably not greater than one half of said arcuate length.

The cut-out may be of scallop-like form, and preferably has an inner surface comprising convex and concave smoothly merging sections to provide for smooth operation of the blade in changing between double and single edge cutting.

According to another aspect of the invention, there is provided a method of cutting an end portion of a carton blank comprising the steps of cutting a slot in the carton blank adjacent one end of the carton blank, the slot having a lengthwise direction and being incomplete on one side for a portion of the length thereof, making a cut in the carton blank transverse to said direction, the slot cutting and cut making steps together severing from the carton blank an integral piece of scrap comprising a strip portion connected to another portion by a bridging piece created by the slot being incomplete on one side, and collecting the integral piece of scrap. The slot cutting and cut making steps may be performed at the same time or either performed before the other Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIG. 1 illustrates in plan view a typical carton blank made in accordance with the prior art;

FIG. 2 illustrates the scrap produced from the left-hand side of the carton blank of FIG. 1 during its production in accordance with the prior art;

FIG. 3 is a diagrammatic representation in side elevation of a carton blank manufacturing machine incorporating the present invention, the near side frame members and covers and other parts having been omitted for simplicity and clarity and some parts shown in section;

DETAILED DESCRIPTION OF THE PREFERRED EMBODIMENT

Figure 4:
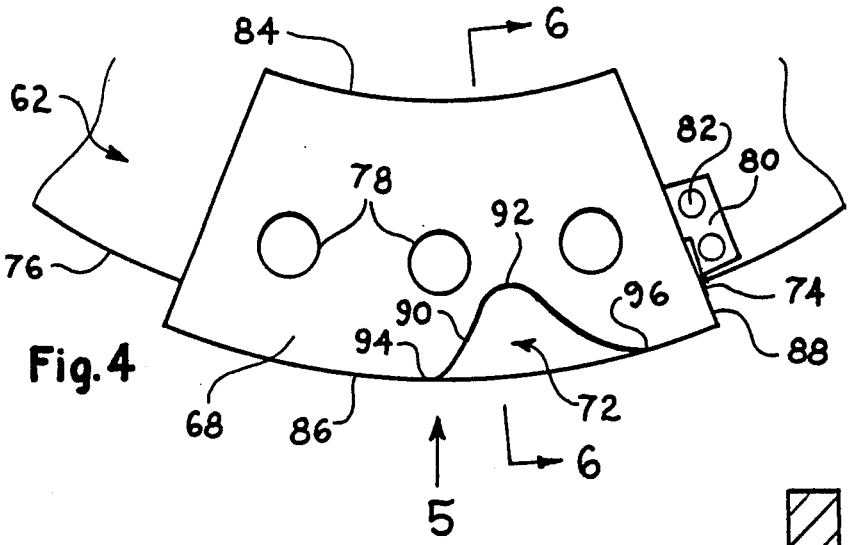
FIG. 4 is a fragmentary side elevation of an end male cutter head of the machine of FIG. 3 showing a stitch flap slot cutter and knife assembly according to the invention.

FIG. 1 illustrates in plan view a typical carton blank 20 as currently produced on flexographic printer slotter machines. The carton blanks are made from sheets of corrugated paperboard or the like by printing, scoring, and slotting the paperboard sheets at pre-arranged locations. Each of these operations may be carried out in consecutive sections in the same machine. The scoring and slotting operations define flaps which are later folded over to form finished cartons. The carton blank 20 has score lines 22, slots 24, and cut-outs 26. The slots 24 define end flaps 28, the score lines 22 define side panels 30, and the cut-outs 26 define a stitch flap 32, sometimes called a glue flap, which is stitched, glued or stapled to the opposite end side panel 30 when the carton blank is erected into a carton. Each cut-out 26 is formed by cutting a slot, such as one of the slots 24, in conjunction with making a cross-cut with a serrated bevelled edge knife to complete the edge 34 of the cut-out 26.

Figure 13:
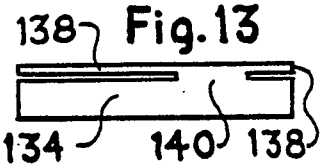
FIG. 13 is a plan view of the integrally formed piece of scrap that is produced when cutting a stitch flap in accordance with the invention.

FIG. 2 illustrates the scrap produced when making the slots 24 and the cut-out 26 in the left-hand side of the blank of FIG. 1. The cutting of each slot 24 produces a narrow strip 36 of scrap. The production of each cut-out 26 produces two separate pieces of scrap; firstly a narrow slot strip 38, similar to the strips 36, and secondly a larger rectangular piece 40. The strips 36 become wedged in grooves in female cutter heads and so can be controlled. However, the larger scrap pieces 40 tend to be thrown off and away from the associated cutter head and are usually randomly scattered in and around the carton blank manufacturing machine. This creates obvious inconvenience as is well known. The present invention is concerned with eliminating or mitigating this inconvenience, and produces the scrap strip 38 and the larger scrap piece 40 as a single integral piece of scrap as illustrated in FIG. 13.

FIG. 3 diagrammatically illustrates a typical carton blank manufacturing machine 42 modified in accordance with the present invention. The machine 42 supports a stack 44 of paperboard sheets in a sheet feed section 46. This is followed by one or more printing sections of which two sections 48 and 50 are shown and through which a sheet 52 is shown being fed and printed. A pair of pull rolls 53 guide and advance the sheet 52 from the printing section 50. Finally, at the discharge end of the machine, are scoring and slotting sections 54 and 56. The scoring section 54 has a scoring shaft 58 carrying upper creaser heads 59 upon which are male creasing contours (not visible in FIG. 3) which cooperate with a resilient covering (not visible in FIG. 3) on lower creaser heads 61 carried on shaft 60. The final slotting section 56 has an upper shaft 62 with male slotter heads 63 and a lower shaft 64 with female slotter heads 65. Each male slotter head 63 carries two slot cutting blades 66 and 68. All the various rolls are geared together and rotate in the directions indicated by arrows to successively feed paperboard sheets from the stack 44 through the machine 42 from right to left in FIG. 3. The slot cutting blades 66, 68 (hereinafter called "slotter blades") on one upper slotter head 63 at one end of the shaft 62 and the female slotter blades 110 on lower slotter head 65 cooperating therewith are modified according to the invention by the provision of scallop-like cavities 70, 72 as will be described below. Most of the mechanisms of the machine 42 are conventional and for further understanding thereof, particularly the manner of construction of the male and female slotter heads 63 and 65 on shafts 62 and 64, reference is made to U.S. Pat. No. 3,540,357 the whole disclosure in which is hereby incorporated by reference.

The slotter blades 66 and 68, associated with the end male slotter head (also called a stitch flap head) at which the stitch flap is formed, are similar but adapted so that the blade 68 makes a leading slot cut and the blade 66 a trailing slot cut in each carton blank. Both blades 66, 68 preferably have a serrated bevelled edge knife associated therewith for completing the cutting of the stitch flap, although a bevelled non-serrated knife may be used if desired. The leading slotter blade 68 and its associated serrated knife will now be described in greater detail with reference to FIGS. 4 to 7.

FIG. 4 shows in side elevation the leading slotter blade 68 and its associated serrated knife 74. The blade 68 is formed as a sector of an annulus and is secured on the end male slotter head 76 of the shaft 62 by three bolts 78. Also secured on the slotter head 76, adjacent the trailing edge of the blade 68, is the thin, flat knife 74 which extends transversely from the general plane of the blade 68. The lower cutting edge of the knife 74 is serrated and bevelled to a sharp cutting edge. The knife 74 is diagrammatically shown mounted in a knife holder bracket 80 secured by bolts 82 to the slotter head 76. The various methods of mounting a serrated knife on a slotter head are well known, including the adjustability of the arcuate location of the knife relative to the slotting blade and the setting of the angle at which the plane of the serrated knife extends from the vertical outer face of the slotter blade, and therefore do not require further description here. The blade 68 has an inner arcuate edge 84 and a longer outer arcuate edge 86. The scallop-like cut-out 72 is machined out of the steel blade 68 at a location partway along the outer arcuate edge 86 intermediate the ends thereof. As shown, the cut-out 72 starts about the midpoint of the arcuate edge 86 and extends for about a quarter to a third of the length of the arcuate edge 86, and may be up to about a half of the arcuate edge 86, finishing a short distance before the trailing edge 88 of the blade. The cut-out 72 extends both into the thickness of the blade 68 and about a quarter to a third of the radial distance towards the inner arcuate edge 84. The radially inner boundary of the cut-out 72 is defined in the outer face of the blade 68 by the curve 90 which is shown asymmetric, but for convenience of manufacture may be symmetric about its midpoint. The curve 90 smoothly leaves and rejoins the arcuate edge 86 at junction points 94 and 96, respectively, and has a curved peak 92 shown closer to the leading junction 94 than to the trailing junction 96.

Figure 5:
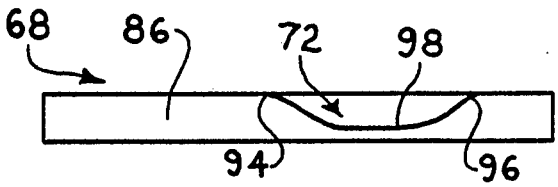
FIG. 5 is an outside edge view of the slot cutting blade of FIG. 4 taken in the direction of the arrow 5 in FIG. 4.

FIG. 5 is a view of the radially outer edge 86 of the blade 68 taken in the direction of the arrow 5 in FIG. 4. As can be seen, the scallop-like cut-out 72 extends well over halfway through the thickness of the blade 68. From the leading junction 94, the inner surface of the cut-out 72 curves into the thickness of the blade, and then, after a flat section 98 parallel to the general plane of the blade, curves back out to the junction point 96. At the flat section 98, the blade may be reduced to one third to one fifth of its thickness, or even less, for example a three eighths of an inch thick blade may be reduced to 0.065 to 0.125 inch.

Figure 6:
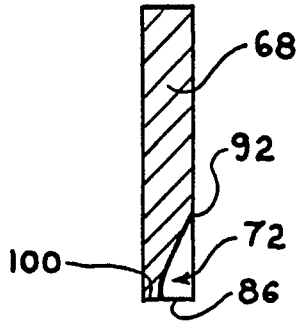
FIG. 6 is a section of the slot cutting blade of FIGS. 4 and 5 taken on the line 6—6 in FIG. 4.

FIG. 6 is a section of the blade 68 on the line 6—6 of FIG. 4. The top 92 of the cut-out 72 curves smoothly into the outer face of the blade 68. The bottom of the cut-out 72 is shown extending about two thirds into the thickness of the blade, leaving the blade at that location with only a narrow portion 100 of the outer arcuate edge 86.

As will be appreciated from FIGS. 4, 5 and 6, the inner bounding wall of the cut-out 72 at its sides and upper portion blends arcuately and smoothly with the outer face of the blade 68. These blending surfaces may each commence convexly and then make a transition to being concave.

Figure 7:
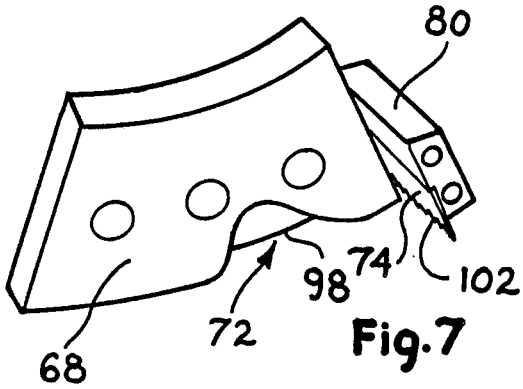
FIG. 7 is a perspective view of the slot cutter and knife assembly of FIG. 4.

FIG. 7 is a perspective view of the blade and cutter assembly of FIG. 4. The scallop-like cut-out 72 can be seen together with the flat section 98 of its inner surface. The knife 74 has a serrated bottom cutting edge 102, and can be seen extending transversely from the outer surface of the blade 68 at a rear location spaced rearwardly from the cut-out 72. The knife 74 forms a crosscut knife. The blade 66 (FIG. 3) and its associated serrated knife are similarly constructed.

Figure 8:
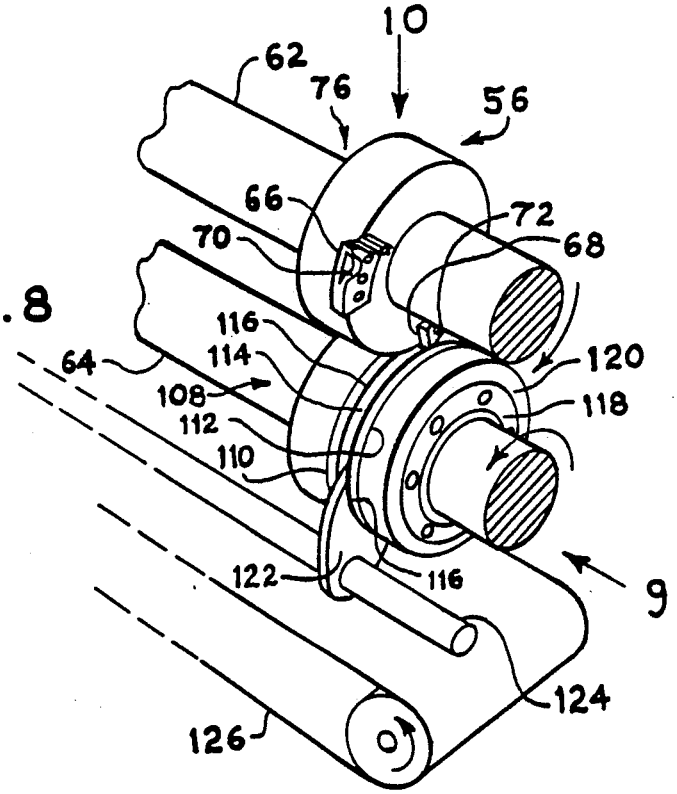
FIG. 8 is a simplified perspective view of a near side portion of the left-hand section of the machine of FIG. 3.

FIG. 8 is a simplified perspective representation of the slotting and cutting section 56 of the machine of FIG. 3, showing the left-hand outer end of that section, that is left-hand when facing in the forward direction of the machine which in FIG. 3 is from right to left. The slotter blades 66, 68 are mounted on the male slotter head 76 which is rigidly secured on the shaft 62. A cooperating female slotter head 108 is rigidly secured on the shaft 64 and forms a nip with the male slotter head 76, through which nip the carton blanks being processed are sequentially fed. The female slotter head includes relatively thick and thin discs, 110 and 112, respectively, defining an annular groove 114 therebetween and having a backing-up cutting edge 116 on opposite sides; these edges 116 are the radially outer peripheral cutting edges of the groove 114. Juxtaposed to the thin disc 112 is an anvil 118 having a resilient cover 120 slidably mounted thereon. A stripper blade 122 is resiliently mounted on a support bar 124 and penetrates into the groove 114 to the bottom thereof against which it is resiliently urged. The stripper blade 122 fits around an arcuate portion of the bottom of the groove 114, substantially fills the axial width of the groove 114, and has a knife-like leading axial edge which cooperates with the bottom of the groove 114 to remove any paperboard scrap engaged therein. The paperboard scrap so removed drops onto an endless conveyor belt 126 extending across the width of the section 56 below the lower slotter head 108 and the support bar 124. The conveyor belt 126 deposits this scrap in a suitable collection system at the other side of the machine.

As will be understood by those skilled in the art, a hardened and ground rigid anvil may be used in place of the resilient anvil 118 against which a non-serrated bevelled edge blade is used to make the transverse cut for completing the stitch flap.

During operation, the slotter blades 68, 66 successively enter the groove to cut respectively leading and trailing slots in each carton blank as it is fed through the section 56 between the rotating male and female slotter heads 76, 108. The blades 68, 66 are a close fit in the groove 114, and the outer peripheral arcuate edges of these blades cooperate with the peripheral backing-up cutting edges 116 of the groove 114 to make two parallel cuts in the paperboard, one each side of the slot being cut therein. The scrap strip so cut-out is forced by the slotting blades 68, 66 into the bottom of the groove 114 from where it is removed by the stripper blade 122. The cross-cut serrated knives associated with the slotting blades 68, 66 cooperate with the resiliently covered anvil 118 to make transverse cuts through the carton blanks to form the leading and trailing edges of the stitch flaps. The serrated blades penetrate into the resilient cover 120 during this cutting operation, the cover 120 rotatably sliding on the anvil 118 during this penetration to reduce damage to the cover 120. Due to the scalloped cut-outs 72, 70 in the slotter blades 68, 66, the scrap portion cut-out by each serrated knife, to form the stitch flap, remains integrally attached to the scrap slot strip cut out by the respective slotter blade (see FIG. 13). As the scrap slot strip is wedged in the bottom of the groove 114, these integrally connected scrap portion and strip are carried by the groove 114 to the stripper blade 122 which removes the scrap slot strip and deposits the integrally connected scrap portion and strip onto the conveyor 126.

The female slotter blades 110, 112 are modified to aid conveyance of the integral scrap portion and strip to the stripper blade 122, and to reduce any tendency for the stitch flap scrap portion to pull the integral scrap strip out of the groove 114. This modification is illustrated in FIGS. 9 and 10.

Figure 9:
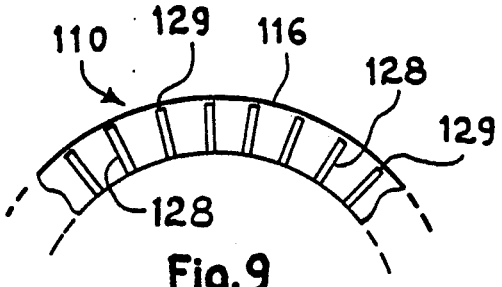
FIG. 9 is a fragmentary side elevational view of one of two discs of a female cutter head of the machine section of FIG. 8.

FIG. 9 is an end view, in the direction of the arrow 9 in FIG. 8, of an arcuate portion of the groove bounding annular side surface of the thicker disc 110. This surface has shallow and narrow radially extending channels 128 formed therein at equal intervals around the entire annular surface. The channels 128 extend outwardly from the bottom of the female cutting groove 114 (FIG. 8) and stop just short of the peripheral backing-up cutting edge 116 of the disc 110. Thus, the channels 128 have radially outer closed ends 129. The opposed surface of the thinner disc 112 (FIG. 8), forming the other side of the female cutting groove 114, has similarly formed outwardly extending channels which are arranged axially opposite the channels 128.

Figure 10:
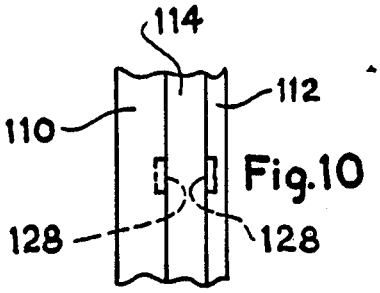
FIG. 10 is a fragmentary top view of the two discs making up a female cutter head of the machine section of FIG. 8.

FIG. 10 is a top view of a fragment of the female slotter head 108 looking downwardly in FIG. 8 in the direction of the arrow 10. Opposed identical radial channels 128 of rectangular cross-section, one in the thicker disc 110 and the other in the thinner disc 112, can be seen in broken lines disposed on each side of the female cutting groove 114. The channels 128 are shown in broken lines as their radially outer ends are closed to provide a continuous radially outer peripheral cutting edge on each side of the groove 114 for cutting cooperation with the male slotter blades 66, 68.

During operation, when the scrap strip cut out by one of the male slotter blades 66, 68 is forced thereby into the female cutting groove 114, this scrap strip is somewhat compressed and extends into the radial channels 128 to relieve such compression. The radial channels 128 thus positively grip the edges of the scrap strip and positively convey this strip, with its integrally attached stitch flap scrap portion, to the cam-like stripper blade 122. The closed radially outer ends of the channels 128 further positively retain the scrap strips in the groove 114 until stripped out. Preferably the channels 128 are spaced apart at 15 degree intervals around each side of the groove 114.

It has been found that arcuately extending relief channels, concentric with the axis of rotation of the female slotter head, are not as satisfactory as scrap tends to become lodged therein and is reluctant to clear. However, by providing outwardly extending relief channels, preferably radially extending channels, a self-clearing action occurs when the scrap strip is removed by the stripper blade 122.

Figure 11:
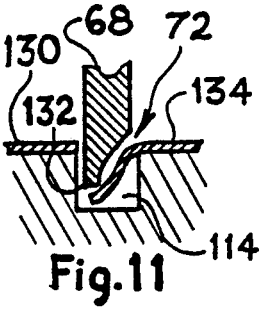
FIG. 11 is a diagrammatic representation, in cross-section, of the slot cutting blade of FIGS. 4 to 7 making a stitch flap cut in a carton blank in accordance with the invention.

FIG. 11 illustrates diagrammatically the action of the scallop-like cut-out in each slotter blade 66, 68 upon a carton blank when the scallop-like cut-out enters the female cutting groove 114. The slotter blade 68 partially illustrated corresponds to the view of the blade 68 in FIG. 6. The carton blank 130 is cut by the scissor-type action between the left-hand side peripheral cutting edge of the groove 114 and the cooperating left-hand arcuate cutting edge 132 of the blade 68. However, due to the scalloped relief formed by the cut-out 72 in the other side of the blade 68, no scissor-type cutting action occurs on the right-hand side of the female cutting groove 114 in FIG. 11. As can be seen, the cut-out 72 allows the paperboard of the blank 130 below the blade 68 to be bent down into the groove 114 while still remaining attached to the portion 134 to the right. The portion 134 is in fact the stitch flap scrap portion cut from the blank 130 by the associated serrated knife 74 (FIG. 7).

Figure 12:
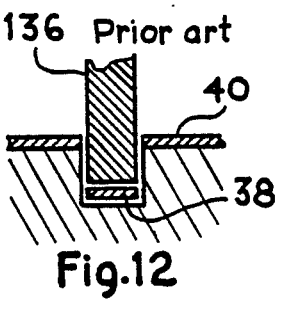
FIG. 12 is a similar view to FIG. 11 illustrating the same cut in accordance with the prior art.

In contrast, FIG. 12 shows a similar view to FIG. 11 but illustrating the action of a stitch flap, slotter blade 136 as used in the prior art without the scallop-like cut-out of the present invention. Both peripheral arcuate edges of the blade 136 cooperate in a scissor-type action with both cutting edges of the female cutting groove to cut the strip 38 from the blank. Although this scrap strip 38 is forced by the blade 136 into the female cutting groove, the stitch flap scrap portion 40 is left free to be thrown off into or around the machine.

As will be appreciated, the slotter blades 66, 68 of the present invention, while only having a single edge slit cutting action in the vicinity of the cut-outs 70, 72, have a double edge cutting action as illustrated in FIG. 12 peripherally before and after the cut-outs 70, 72. The scallop-like shape of the cut-outs 70, 72 facilitates a smooth transition from double edge cutting action to the single edge cutting action and then back again to double edge cutting action.

FIG. 13 shows, in plan view, an integral piece of scrap produced in cutting a stitch flap in accordance with the present invention. A scrap strip 138 produced by the slot cutting action of the blade 68 is integrally connected by a bridging piece 140 to the larger scrap portion 134 cutoff by the serrated knife 74 in forming an edge of the stitch flap. The bridging piece 140 is provided by the single edge cutting of the blade 68 in the vicinity of the cut-out 72, as illustrated in FIG. 11.

In comparison with the scrap produced by the prior art as shown in FIG. 2, the strip 138 in FIG. 13 corresponds to the scrap strip 38 in FIG. 2, and the scrap portion 134 in FIG. 13 corresponds to the scrap portion 40 in FIG. 2. However, due to the bridging piece 140 in FIG. 13, the scrap portion 134 is controlled according to the present invention by being carried along with the strip 138 which is wedged in the groove 114 of the female slotter head 108.

It has been found that the bridging piece 140 is best kept fairly short in comparison with the length of the strip 138. If the bridging piece 140 is too long, there is a tendency for the stiffness of the bridging piece to cause the strip 138 to lift in the groove 114 and become dislodged therefrom. A convenient length of the bridging piece 140 is less than about one half, and preferably between one third and one quarter, of the length of the strip 138.

Figure 14:
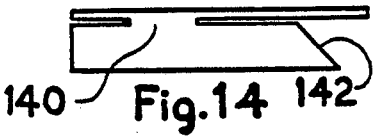
FIG. 14 is a similar view to FIG. 13 of the integral piece of scrap produced in accordance with the invention when cutting a differently shaped stitch flap.

FIG. 14 is a similar view to FIG. 13 of the shape of the integral piece of scrap produced when cutting a differently shaped stitch flap in accordance with the invention. In the production of this, the serrated knife 102 (FIG. 7) would have been adjusted to a position intermediate the length of the slot cutting blade. Also, the serrated knife would have been adjusted to extend backwardly at an acute angle to the general plane of the slot cutting blade to produce the angled edge 142. As can be seen, the bridging piece 140 is further to the left than in FIG. 13.

As will be appreciated, in cutting a stitch flap in accordance with the invention, the two edge cutting of a slot cutting blade is changed to one edge cutting over a fraction of the cutting length of the blade. This, in conjunction with the knife cut transverse to the blade and the positioning thereof, produces the integral piece of scrap having a bridging piece.

It will be appreciated that the above incorporation of a bridging piece, between a scrap strip and another portion of scrap produced when slot cutting and/or shaping an end of a carton blank, can be employed other than for just forming stitch flaps. The present invention includes shaping or cutting an end of a carton blank in such a way as to form an integral piece of scrap having a bridging piece enabled by a scalloped cutting blade cooperating with another cutting blade.

Further, the incorporation of outwardly extending channels, like the channels 128, in the opposite side walls of other cutting grooves in female slotter heads, particularly female slotter heads along the shaft 64 in FIGS. 3 and 8 intermediate the end female slotter heads, is also contemplated by the present invention. Such channels will similarly provide the advantage of more positively retaining and conveying the cut-out scrap strips in the female cutting grooves until stripped therefrom by appropriate stripper blades.

The above described embodiments, of course, are not to be construed as limiting the breadth of the present invention. Modifications, and other alternative constructions, will be apparent which are within the spirit and scope of the invention as defined in the appended claims.

What is claimed is:

1. Apparatus for cutting an end portion of a carton blank, comprising:

a rotatably driven male cutting head cooperating with a rotatably driven female cutting head;

said female cutting head having a peripheral cutting groove therein and an anvil surface adjacent one side of said groove;

said male cutting head having a two edged slot cutting blade of predetermined arcuate length which enters said groove, and a knife which extends transversely away from said blade and engages said anvil surface;

said blade having a cut-out in one side thereof adjacent said one side of said groove and extending along a portion of said arcuate length, said cut-out modifying said blade to a single edged cutting blade along said portion;

said blade cutting a strip of scrap from the carton blank and forcing said strip into said groove;

said one side of said blade and a transverse cut made by said knife cooperatively cutting another portion of scrap from said carton blank, said another portion of scrap being connected to said strip of scrap by a bridging piece enabled by said cut-out of said blade;

means, cooperating with said female cutting head, for stripping said strip from said groove with said another portion of scrap still connected to said strip; and means for receiving from said stripping means, and then removing, said strip with said another portion of scrap connected thereto, whereby removal of said another portion of scrap is controlled.

2. The apparatus of claim 1, wherein said portion of said arcuate length is intermediate ends of said predetermined arcuate length of said blade.

3. The apparatus of claim 2, wherein said portion of said arcuate length is spaced from said ends.

4. The apparatus of claim 1, wherein said portion of said arcuate length is not greater than one half of said arcuate length.

5. The apparatus of claim 4, wherein said portion of said arcuate length is not greater than one quarter of said arcuate length.

6. The apparatus of claim 1, wherein said cut-out is of scallop-like form.

7. The apparatus of claim 6, wherein said cut-out has an inner surface which comprises convex and concave sections which merge smoothly together.

8. The apparatus of claim 2, wherein said knife has a cutting edge which is serrated.

9. The apparatus of claim 1, wherein said groove has opposed side walls with radial channels therein.

10. The apparatus of claim 9, wherein said channels are equispaced around said groove, and channels in one side wall of said groove are disposed opposite channels in the other sidewall of said groove.

11. The apparatus of claim 9, wherein said groove has radially outer peripheral cutting edges on opposite sides thereof, and said channels terminate radially outwardly short of said peripheral cutting edges.

12. The apparatus of claim 1, wherein said stripping means comprises a stationary stripper blade continuously engaged in said groove and cooperating with a bottom of said groove.

13. The apparatus of claim 12, wherein said receiving and removing means comprises means, disposed below said stripper blade, for conveying away said scrap portions.

14. The apparatus of claim 13, wherein said conveying means comprises an endless belt conveyor.

15. Apparatus for slotting paperboard sheets, comprising:

a first rotatable slotting head having a slotting groove therein and an anvil surface to one side of said groove;

a second rotatable slotting head having a slotting blade extending radially therefrom and intermittently engageable in said groove for cutting slots in paperboard sheets fed between said heads;

said second head having a knife extending transversely to said slotting blade and intermittently cooperating with said anvil surface for making in said paperboard sheets cuts extending transversely from said slots;

a scallop-like cut-out in a side of said blade nearest said anvil surface, said cut-out being intermediate leading and trailing edges of said blade and reducing in thickness a portion of a double edged, radially outer cutting surface of said blade, said cut-out enabling an integral scrap portion to be cut from each paperboard sheet by said blade and said knife;

said groove having opposed side walls with radial channels formed therein to aid gripping of part of said integral scrap portion by said groove;

removing means, engaging in said groove, for removing said part of said scrap portion therefrom; and conveyor means for conveying away from said removing means said integral scrap portion after said part of said scrap portion has been removed from said groove.

16. A method of cutting an end portion of a carton blank, comprising the steps of:

cutting a slot in the carton blank adjacent one end of the carton blank, the slot having a lengthwise direction and being incomplete on one side for a portion of the length thereof;

making a cut in said carton blank transverse to said direction;

said slot cutting and cut making steps together severing from the carton blank an integral piece of scrap comprising a strip portion connected to another portion by a bridging piece created by said slot being incomplete on said one side for said portion of the length thereof; and collecting said integral piece of scrap.

17. The method of claim 16, wherein said cut making step is performed while said slot cutting step is being performed.

18. The method of claim 16, wherein said one side is uncut at a location spaced along said slot in said direction intermediate ends of said slot.

19. The method of claim 16, wherein;

said cutting step is performed by passing a rotating slot cutting blade into and then out of a slot cutting groove; and said collecting step comprises removing said scrap strip portion from said groove and allowing said integral piece of scrap to drop onto a conveyor.

20. The method of claim 16, wherein said cutting an incomplete slot is performed by passing a slot cutting blade having a cut-out in one side thereof into and then out of a slot cutting groove.

21. The method of claim 16, wherein said strip portion is forced into a slot cutting groove by a slot cutting blade as said step of cutting a slot is performed by said cutting blade, and further comprising the steps of:

allowing edges of said strip portion to expand into channels in sides of said groove, said channels extending longitudinally transversely to said strip portion; and conveying said strip portion with said another portion connected thereto by moving said groove with said channels positively gripping said strip portion; and wherein said collecting step includes removing said strip portion from said groove and said channels with said another portion still connected to said strip portion, whereby movement and collection of said another portion is controlled due to said bridging piece.

22. The method of claim 16, wherein said slot cutting step precedes said cut making step.

23. A method of controlling scrap when forming a carton blank with a stitch flap, comprising the steps of:

scoring a carton blank to define side panels thereof;

slotting the carton blank to define end flaps thereof;

said slotting including cutting a slot in a lengthwise direction in the carton blank adjacent one end of the carton blank by passing the carton blank between a rotating slot cutting blade and a rotating slot cutting groove;

making a cut in said carton blank transverse to said direction, said cut extending from said slot to said one end of the carton blank to define one side of a stitch flap and also to define a portion of scrap at said one end of the carton blank between said slot and said cut;

said cutting a slot being performed by two cutting edges of said blade cooperating with opposite cutting edges of said groove, said blade entering said groove to cut a strip from said carton blank and force said strip into said groove;

said cutting a slot also including leaving an uncut part along a portion of a side of said slot between said strip and said portion of scrap, said uncut part being enabled by a cut-out in a side of said blade immediately adjacent said portion of scrap, said uncut part forming a bridging piece integrally connecting said portion of scrap to said strip;

allowing edges of said strip to key into radial channels in opposing sides of said groove to enable said groove to positively grip said strip;

moving said strip so gripped by said groove by rotating of said groove;

stripping said strip out of said groove; and allowing said strip with said portion of scrap integrally connected thereto to fall onto a conveyor.

* * * * *